US009951477B2

(12) United States Patent
Zwick et al.

(10) Patent No.: US 9,951,477 B2
(45) Date of Patent: Apr. 24, 2018

(54) HIGH BASIS WEIGHT TISSUE WITH LOW SLOUGH

(71) Applicant: Kimberly-Clark Worldwide, Inc., Neenah, WI (US)

(72) Inventors: Kenneth John Zwick, Neenah, WI (US); Peter Lee Carson, Ulverston (GB); Michael William Smaby, Neenah, WI (US); Gary Lee Shanklin, Fremont, WI (US); Michael John Rekoske, Appleton, WI (US); Mike Thomas Goulet, Neenah, WI (US); Thomas Joseph Dyer, Neenah, WI (US); John Alexander Werner, IV, New Milford, CT (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

(21) Appl. No.: 15/241,211

(22) Filed: Aug. 19, 2016

(65) Prior Publication Data

US 2016/0355990 A1 Dec. 8, 2016

Related U.S. Application Data

(63) Continuation of application No. 13/588,171, filed on Aug. 17, 2012, now abandoned.

(51) Int. Cl.

| | |
|---|---|
| ***D21H 27/40*** | (2006.01) |
| ***D21H 17/34*** | (2006.01) |
| ***D21H 27/00*** | (2006.01) |
| ***D21H 11/04*** | (2006.01) |

(52) U.S. Cl.

CPC ..... *D21H 27/40* (2013.01); *D21H 11/04* (2013.01); *D21H 17/34* (2013.01); *D21H 27/002* (2013.01); *D21H 27/005* (2013.01); *Y10T 428/24455* (2015.01); *Y10T 428/24463* (2015.01)

(58) Field of Classification Search

CPC ..... D21H 27/40; D21H 27/005; D21H 11/04; D21H 17/34; D21H 27/002; Y10T 428/24463; Y10T 428/24455

See application file for complete search history.

(56) References Cited

U.S. PATENT DOCUMENTS

| | | | |
|---|---|---|---|
| 3,879,257 | A | 4/1975 | Gentile et al. |
| 4,158,594 | A | 6/1979 | Becker et al. |
| 4,166,001 | A | 8/1979 | Bicho et al. |
| 4,574,021 | A | 3/1986 | Endres et al. |
| 4,816,320 | A | 3/1989 | St. Cyr |

(Continued)

FOREIGN PATENT DOCUMENTS

| | | |
|---|---|---|
| EP | 0 144 658 A1 | 6/1985 |
| EP | 1 112 177 B1 | 2/2012 |

(Continued)

*Primary Examiner* — Nathan L Van Sell

(74) *Attorney, Agent, or Firm* — Kimberly-Clark Worldwide, Inc.

(57) ABSTRACT

Low slough, high basis weight tissue webs and products are provided. The tissue webs generally have basis weights greater than about 16 grams per square meter (gsm), while maintaining less than about 4 mg of slough. All while yielding tissue products that are both thick and soft.

16 Claims, 2 Drawing Sheets

(56) References Cited

U.S. PATENT DOCUMENTS

| | | | |
|---|---|---|---|
| 4,950,545 | A | 8/1990 | Walter et al. |
| 5,164,046 | A | 11/1992 | Ampulski et al. |
| 5,730,839 | A | 3/1998 | Wendt et al. |
| 5,830,317 | A | 11/1998 | Vinson et al. |
| 5,846,380 | A | 12/1998 | Van et al. |
| 5,968,853 | A | 10/1999 | Kelly et al. |
| 5,981,044 | A | 11/1999 | Phan et al. |
| 6,054,020 | A | 4/2000 | Goulet et al. |
| 6,162,327 | A | 12/2000 | Batra et al. |
| 6,241,850 | B1 | 6/2001 | Kelly |
| 6,332,952 | B1 | 12/2001 | Hsu et al. |
| 6,454,901 | B1 | 9/2002 | Sekiya et al. |
| 6,517,678 | B1 | 2/2003 | Shannon et al. |
| 6,656,569 | B1 | 12/2003 | Roussel et al. |
| 6,797,114 | B2 | 9/2004 | Hu |
| 6,821,387 | B2 | 11/2004 | Hu |
| 6,861,380 | B2 | 3/2005 | Garnier et al. |
| 7,029,756 | B2 | 4/2006 | Moline et al. |
| 7,517,433 | B2 | 4/2009 | Zwick et al. |
| 7,785,443 | B2 | 8/2010 | Hermans et al. |
| 7,803,249 | B2 | 9/2010 | Dyer et al. |
| 7,807,023 | B2 | 10/2010 | Dyer et al. |
| 7,879,190 | B2 | 2/2011 | Dyer et al. |
| 7,883,604 | B2 | 2/2011 | Dyer et al. |
| 8,025,764 | B2 | 9/2011 | Bhat et al. |
| 8,070,913 | B2 | 12/2011 | Salaam et al. |
| 8,123,905 | B2 | 2/2012 | Luu et al. |
| 9,243,367 | B2 | 1/2016 | Rekoske et al. |
| 9,283,730 | B2 | 3/2016 | Zwick et al. |
| 2003/0121627 | A1 | 7/2003 | Hu et al. |
| 2003/0131960 | A1 | 7/2003 | McConnell et al. |
| 2003/0192662 | A1 | 10/2003 | Heath et al. |
| 2004/0163785 | A1 | 8/2004 | Shannon et al. |
| 2004/0250969 | A1 | 12/2004 | Luu et al. |
| 2006/0042767 | A1 | 3/2006 | Bhat et al. |
| 2006/0137842 | A1* | 6/2006 | Garnier ..... A61L 15/26 162/158 |
| 2006/0144536 | A1* | 7/2006 | Nickel ..... D21H 27/002 162/111 |
| 2007/0137810 | A1 | 6/2007 | Dyer et al. |
| 2007/0144697 | A1 | 6/2007 | Dyer et al. |
| 2008/0073045 | A1* | 3/2008 | Dyer ..... A47K 10/16 162/112 |
| 2008/0187733 | A1 | 8/2008 | Abbosh et al. |
| 2009/0188637 | A1 | 7/2009 | Chan et al. |
| 2010/0155004 | A1 | 6/2010 | Wang et al. |
| 2010/0212849 | A1 | 8/2010 | Smith et al. |
| 2010/0224338 | A1 | 9/2010 | Harper et al. |
| 2011/0198776 | A1 | 8/2011 | Sekiya et al. |
| 2011/0303374 | A1 | 12/2011 | Chan et al. |
| 2011/0303375 | A1 | 12/2011 | Shannon et al. |
| 2012/0125552 | A1 | 5/2012 | Goulet et al. |
| 2012/0164200 | A1 | 6/2012 | Qin et al. |
| 2012/0255694 | A1 | 10/2012 | Druecke et al. |

FOREIGN PATENT DOCUMENTS

| | | | |
|---|---|---|---|
| GB | 2 006 296 | A | 5/1979 |
| WO | WO 2008/003343 | A1 | 1/2008 |
| WO | WO 2012/137102 | A2 | 10/2012 |

* cited by examiner

HIGH BASIS WEIGHT TISSUE WITH LOW SLOUGH

RELATED APPLICATIONS

The present application is a continuation application and claims priority to U.S. patent application Ser. No. 13/588,171, filed on Aug. 17, 2012, which is incorporated herein by reference.

BACKGROUND

In the manufacture of paper products, such as facial tissues, bath tissues, napkins, wipes, paper towels, etc., it is often desired to optimize various properties of the products. For example, the products should have good bulk, a soft feel, and should have good strength. Unfortunately, however, when steps are taken to increase one property of the product, other characteristics of the product are often adversely affected.

For instance, it is very difficult to produce a high strength paper product that is also soft. In particular, strength is typically increased by the addition of certain strength or bonding agents to the product. Although the strength of the paper product is increased, various methods are often used to soften the product that can result in decreased fiber bonding. For example, chemical debonders can be utilized to reduce fiber bonding and thereby increase softness. Moreover, mechanical forces, such as creping or calendering, can also be utilized to increase softness.

However, reducing fiber bonding with a chemical debonder or through mechanical forces can adversely affect the strength of the paper product. For example, hydrogen bonds between adjacent fibers can be broken by such chemical debonders, as well as by mechanical forces of a papermaking process. Consequently, such debonding results in loosely bound fibers that extend from the surface of the tissue product. During processing and/or use, these loosely bound fibers can be freed from the tissue product, thereby creating lint, which is defined as individual airborne fibers and fiber fragments. Moreover, papermaking processes may also create zones of fibers that are poorly bound to each other but not to adjacent zones of fibers. As a result, during use, certain shear forces can liberate the weakly bound zones from the remaining fibers, thereby resulting in slough, i.e., bundles or pills on surfaces, such as skin or fabric. As such, the use of such debonders can often result in a much weaker paper product during use that exhibits substantial amounts of lint and slough.

As such, a need currently exists for a paper product that is strong, soft, and that has low lint and slough.

SUMMARY

Typically, increased basis weight, and in-turn sheet caliper, have a negative impact on creping and often causes increased slough in the finished tissue product. Despite this trend, the present disclosure surprisingly provides a high basis weight web having low slough. The novel tissue webs generally have basis weights greater than about 16 grams per square meter (gsm), while maintaining less than about 4 mg of slough. All while yielding tissue products that are both thick and soft.

Accordingly, in one aspect the present disclosure provides a creped tissue product comprising one or more plies, the tissue product having a geometric mean tensile (GMT) of less than about 1000 g/3", a basis weight of at least about 33 gsm and a slough of less than about 4 mg.

In other aspects the disclosure provides a creped tissue web having a GMT of less than about 500 g/3", a basis weight of at least about 16 gsm and a slough of less than about 4 mg.

In yet other aspects the disclosure provides a soft creped tissue web having a basis weight of at least about 16 gsm, a slough of less than about 4 mg and TS7 value from about 8 to 10. Preferably, soft creped tissues having low slough and TS7 value as also strong enough to withstand use, such that the geometric mean tensile is at least about 300 g/3" and more preferably at least about 400 g/3".

In still other aspects the present disclosure provides a multi-ply tissue product comprising two multi-layered creped tissue webs, the tissue webs having three superposed layers, an inner layer consisting essentially of softwood fibers and two outer layers consisting essentially of hardwood fibers, the inner layer being located between the two outer layers, wherein each web has a GMT of less than about 500 g/3", a basis weight of at least about 16 gsm and a slough of less than about 4 mg.

In still other aspects the disclosure provides a high basis weight tissue web having a creping composition applied at high levels of addition. For example, tissue webs according to the present disclosure may be produced by applying a non-fibrous olefin polymer to the Yankee dryer at high addition levels, preferably greater than about 50 mg/m$^2$ (the add on rate of creping composition to the dryer, measured as dry mass (i.e., mg) per unit area of dryer surface (i.e., m$^2$)). The resulting tissue webs have low slough, such as a slough less than about 4 mg, even at basis weights greater than about 16 gsm.

In yet other aspects the disclosure provides a process for producing a creped tissue web product comprising the steps of applying an aqueous polyolefin dispersion to a moving creping surface, wherein said aqueous polyolefin dispersion comprises at least one thermoplastic resin, water, and at least one dispersing agent, wherein said aqueous polyolefin dispersion has an average particle size in the range of from 0.05 μm to 5 μm and a pH in the range of from 7 to 11, and wherein said dispersion comprises more than 25 percent by weight of water; pressing a base sheet having a basis weight of at least about 16 gsm against the creping surface after the aqueous polyolefin dispersion has been applied, the aqueous polyolefin dispersion adhering the base sheet to the creping surface; and removing the base sheet from the creping surface, wherein the creped base sheet has a slough of less than about 4 mg and a GMT less than about 500 g/3".

Other features and aspects of the present disclosure are discussed in greater detail below.

DEFINITIONS

Figure 1:
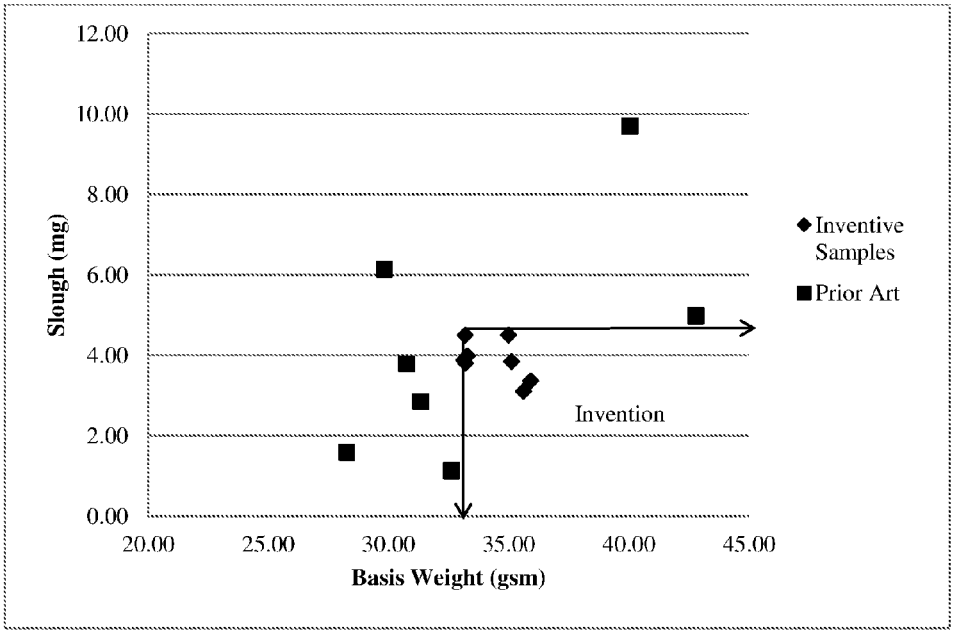
FIG. 1 is a comparison of basis weight (x-axis, grams per square meter) and slough (y-axis, mg) for various prior art and inventive tissue products.

As used herein, the term "slough," also referred to herein as "pilling" and "Scott pilling," refers to the undesirable sloughing off of bits of the tissue web when rubbed and is generally measured as described in the Test Methods section below. Slough is generally reported in terms of mass, such as milligrams.

As used herein, the term "geometric mean tensile" (GMT) refers to the square root of the product of the machine direction tensile and the cross-machine direction tensile of the web, which are determined as described in the Test Methods section.

As used herein, the term "slope," also referred to as "modulus," refers to slope of the line resulting from plotting tensile versus stretch and is an output of the MTS TestWorks™ in the course of determining the tensile strength as described in the Test Methods section. Slope is reported in the units of grams (g) per unit of sample width (inches) and is measured as the gradient of the least-squares line fitted to the load-corrected strain points falling between a specimen-generated force of 70 to 157 grams (0.687 to 1.540 N) divided by the specimen width.

As used herein, the term "geometric mean modulus" (GMM) generally refers to the square root of the product of the machine direction and cross-machine direction slopes, and is an output of the MTS TestWorks™ in the course of determining the tensile strength as described in the Test Methods section.

As used herein, the term "tissue product" refers to products made from base webs comprising fibers and includes, bath tissues, facial tissues, paper towels, industrial wipers, foodservice wipers, napkins, medical pads, and other similar products.

As used herein, the terms "tissue web" and "tissue sheet" refer to a cellulosic web suitable for making for use as a tissue product.

As used herein, the term "caliper" is the representative thickness of a single sheet measured in accordance with TAPPI test methods T402 "Standard Conditioning and Testing Atmosphere For Paper, Board, Pulp Handsheets and Related Products" and T411 om-89 "Thickness (caliper) of Paper, Paperboard, and Combined Board" with Note 3 for stacked sheets. The micrometer used for carrying out T411 om-89 is an Emveco 200-A Tissue Caliper Tester (Emveco, Inc., Newberg, Oreg.). The micrometer has a load of 2 kilo-Pascals, a pressure foot area of 2500 square millimeters, a pressure foot diameter of 56.42 millimeters, a dwell time of 3 seconds and a lowering rate of 0.8 millimeters per second. Caliper may be expressed in mils (0.001 inches) or microns.

As used herein the term "basis weight" generally refers to the conditioned weight per unit area of a tissue and is generally expressed as grams per square meter (gsm). Basis weight is measured herein using TAPPI test method T-220.

DETAILED DESCRIPTION

In general, the present disclosure is directed to creped tissue webs, and products produced therefrom. The creped webs and products are strong, soft, and have low amounts of slough, such as less than about 6 mg and more preferably less than about 4 mg, even at basis weights in excess of 16 gsm per ply and geometric mean tensile of less than about 500 g/3" per ply. As such, the tissue webs are strong and soft, yet have low slough. Surprisingly, the combination of favorable properties is achieved without post treatment of the web with silicones, lotions, or the like.

In one embodiment, the tissue webs are creped, wherein the creping composition comprises a thermoplastic resin, such as the composition disclosed in U.S. Pat. No. 7,807,023, which is incorporated herein in a manner consistent with the present disclosure. The thermoplastic resin may be contained, for instance, in an aqueous dispersion prior to application to the creping surface. In one particular embodiment, the creping composition may comprise a non-fibrous olefin polymer. The creping composition, for instance, may comprise a film-forming composition and the olefin polymer may comprise an interpolymer of ethylene and at least one comonomer comprising an alkene, such as 1-octene. The creping composition may also contain a dispersing agent, such as a carboxylic acid. Examples of particular dispersing agents, for instance, include fatty acids, such as oleic acid or stearic acid.

In one particular embodiment, the creping composition may contain an ethylene and octene copolymer in combination with an ethylene-acrylic acid copolymer. The ethylene-acrylic acid copolymer is not only a thermoplastic resin, but may also serve as a dispersing agent. The ethylene and octene copolymer may be present in combination with the ethylene-acrylic acid copolymer in a weight ratio of from about 1:10 to about 10:1, such as from about 2:3 to about 3:2.

The olefin polymer composition may exhibit a crystallinity of less than about 50 percent, such as less than about 20 percent. The olefin polymer may also have a melt index of less than about 1000 g/10 min, such as less than about 700 g/10 min. The olefin polymer may also have a relatively small particle size, such as from about 0.05 micron to about 5 microns when contained in an aqueous dispersion.

In an alternative embodiment, the creping composition may contain an ethylene-acrylic acid copolymer. The ethylene-acrylic acid copolymer may be present in the creping composition in combination with a dispersing agent, such as a fatty acid.

Once applied to a tissue web, it has been discovered that the creping composition may form a discontinuous film depending upon the amount applied to the web. In other embodiments, the creping composition may be applied to a web such that the creping composition forms discrete treated areas on the surface of the web.

Compared to commercially available tissue, tissue prepared according to the present disclosure generally has lower slough even at higher basis weights.

TABLE 1

| Sample | Plies (No.) | Conditioned Basis Weight (gsm) | Slough (mg) | GMT (g/3") | GMM (kg) |
|---|---|---|---|---|---|
| Kleenex ® Mainline Facial Tissue | 2 | 28.27 | 1.59 | 772 | 9.93 |
| Puffs Basic ® Facial Tissue | 2 | 29.82 | 6.13 | 665 | 7.18 |
| Puffs Plus ® Facial Tissue | 2 | 42.79 | 4.98 | 797 | 10.11 |
| Puffs Ultra Strong and Soft ® Facial Tissue | 2 | 40.03 | 9.69 | 1036 | 12.87 |
| Publix ® Facial Tissue | 2 | 32.62 | 1.13 | 741 | 10.75 |
| Up&Up ™ Everyday Facial Tissue | 2 | 30.75 | 3.79 | 814 | 10.59 |
| Scotties ® 2-Ply Facial Tissue | 2 | 31.34 | 2.85 | 816 | 14.82 |
| Inventive Sample | 2 | 35.91 | 3.36 | 860 | 13.44 |
| Inventive Sample | 2 | 35.62 | 3.10 | 1004 | 15.75 |

Accordingly, in certain embodiments the disclosure provides a creped tissue product comprising two or more plies, wherein the product has a basis weight of at least about 33 gsm, and more preferably at least about 35 gsm, such as from about 33 to about 40 gsm. The tissue products preferably have a slough less than about 10 mg, more preferably less than about 8 mg and still more preferably less than about 4 mg. Further, tissue products having low slough and increased basis weight preferably have a geometric mean tensile less than about 1000 g/3" and more preferably less than about 900 g/3" and still more preferably less than about 800 g/3".

In general, any suitable fibrous web may be treated in accordance with the present disclosure. For example, in one aspect, the base sheet can be a tissue product, such as a bath tissue, a facial tissue, a paper towel, a napkin, and the like. Fibrous products can be made from any suitable types of fiber. Fibrous products made according to the present disclosure may include single-ply fibrous products or multiple-ply fibrous products. For instance, in some aspects, the product may include two plies, three plies, or more.

Fibers suitable for making fibrous webs comprise any natural or synthetic fibers including both nonwoody fibers and woody or pulp fibers. Pulp fibers can be prepared in high-yield or low-yield forms and can be pulped in any known method, including kraft, sulfite, high-yield pulping methods and other known pulping methods. Fibers prepared from organosolv pulping methods can also be used, including the fibers and methods disclosed in U.S. Pat. Nos. 4,793,898, 4,594,130, 3,585,104. Useful fibers can also be produced by anthraquinone pulping, exemplified by U.S. Pat. No. 5,595,628.

The fibrous webs of the present disclosure can also include synthetic fibers. For instance, the fibrous webs can include up to about 10 percent, such as up to about 30 percent or up to about 50 percent or up to about 70 percent or more by dry weight, to provide improved benefits. Suitable synthetic fibers include rayon, polyolefin fibers, polyester fibers, bicomponent sheath-core fibers, multi-component binder fibers, and the like. Synthetic cellulose fiber types include rayon in all its varieties and other fibers derived from viscose or chemically-modified cellulose.

Chemically treated natural cellulosic fibers can be used, for example, mercerized pulps, chemically stiffened or crosslinked fibers, or sulfonated fibers. For good mechanical properties in using web forming fibers, it can be desirable that the fibers be relatively undamaged and largely unrefined or only lightly refined. While recycled fibers can be used, virgin fibers are generally useful for their mechanical properties and lack of contaminants. Mercerized fibers, regenerated cellulosic fibers, cellulose produced by microbes, rayon, and other cellulosic material or cellulosic derivatives can be used. Suitable web forming fibers can also include recycled fibers, virgin fibers, or mixes thereof.

In general, any process capable of forming a web can also be utilized in the present disclosure. For example, a web forming process of the present disclosure can utilize creping, wet creping, double creping, recreping, double recreping, embossing, wet pressing, air pressing, through-air drying, hydroentangling, creped through-air drying, co-forming, air-laying, as well as other processes known in the art. For hydroentangled material, the percentage of pulp is about 70-85 percent.

Also suitable for articles of the present disclosure are fibrous sheets that are pattern densified or imprinted, such as the fibrous sheets disclosed in any of the following U.S. Pat. Nos. 4,514,345, 4,528,239, 5,098,522, 5,260,171, and 5,624,790, the disclosures of which are incorporated herein by reference to the extent they are non-contradictory herewith. Such imprinted fibrous sheets may have a network of densified regions that have been imprinted against a drum dryer by an imprinting fabric, and regions that are relatively less densified (e.g., "domes" in the fibrous sheet) corresponding to deflection conduits in the imprinting fabric, wherein the fibrous sheet superposed over the deflection conduits was deflected by an air pressure differential across the deflection conduit to form a lower-density pillow-like region or dome in the fibrous sheet.

The fibrous web can also be formed without a substantial amount of inner fiber-to-fiber bond strength. In this regard, the fiber furnish used to form the base web can be treated with a chemical debonding agent. The debonding agent can be added to the fiber slurry during the pulping process or can be added directly to the headbox. Suitable debonding agents that may be used in the present disclosure include cationic debonding agents such as fatty dialkyl quaternary amine salts, mono fatty alkyl tertiary amine salts, primary amine salts, imidazoline quaternary salts, silicone, quaternary salt and unsaturated fatty alkyl amine salts. Other suitable debonding agents are disclosed in U.S. Pat. No. 5,529,665, which is incorporated herein by reference in a manner consistent herewith.

While the creped webs of the present disclosure achieve low slough, such as less than about 4 mg at geometric mean tensile of less than about 500 g/3" without post treatment, the webs may, in certain embodiments, be post treated to provide additional benefits. The types of chemicals that may be added to the web include absorbency aids usually in the form of cationic, or non-ionic surfactants, humectants and plasticizers such as low molecular weight polyethylene glycols and polyhydroxy compounds such as glycerin and propylene glycol. Materials that supply skin health benefits such as mineral oil, aloe extract, vitamin-E, silicone, lotions in general, and the like, may also be incorporated into the finished products. Such chemicals may be added at any point in the web forming process.

Fibrous webs that may be treated in accordance with the present disclosure may include a single homogenous layer of fibers or may include a stratified or layered construction. For instance, the fibrous web ply may include two or three layers of fibers. Each layer may have a different fiber composition. For example a three-layered headbox generally includes an upper head box wall and a lower head box wall. Headbox further includes a first divider and a second divider, which separate three fiber stock layers.

Each of the fiber layers comprises a dilute aqueous suspension of papermaking fibers. The particular fibers contained in each layer generally depend upon the product being formed and the desired results. For instance, the fiber composition of each layer may vary depending upon whether a bath tissue product, facial tissue product or paper towel is being produced. In one aspect, for instance, the middle layer contains southern softwood kraft fibers either alone or in combination with other fibers such as high yield fibers. Outer layers, on the other hand, contain softwood fibers, such as northern softwood kraft. In an alternative aspect, the middle layer may contain softwood fibers for strength, while the outer layers may comprise hardwood fibers, such as eucalyptus fibers, for a perceived softness.

In general, any process capable of forming a base sheet may be utilized in the present disclosure. For example, an endless traveling forming fabric, suitably supported and driven by rolls, receives the layered papermaking stock issuing from the headbox. Once retained on the fabric, the layered fiber suspension passes water through the fabric. Water removal is achieved by combinations of gravity, centrifugal force and vacuum suction depending on the forming configuration. Forming multi-layered paper webs is also described and disclosed in U.S. Pat. No. 5,129,988, which is incorporated herein by reference in a manner that is consistent herewith.

Preferably the formed web is dried by transfer to the surface of a rotatable heated dryer drum, such as a Yankee dryer. In accordance with the present disclosure, the creping composition may be applied topically to the tissue web while the web is traveling on the fabric or may be applied to the surface of the dryer drum for transfer onto one side of the tissue web. In this manner, the creping composition is used to adhere the tissue web to the dryer drum. In this embodiment, as the web is carried through a portion of the rotational path of the dryer surface, heat is imparted to the web causing most of the moisture contained within the web to be evaporated. The web is then removed from the dryer drum by a creping blade. Creping the web, as it is formed, further reduces internal bonding within the web and increases softness. Applying the creping composition to the web during creping, on the other hand, may increase the strength of the web.

In another embodiment the formed web is transferred to the surface of the rotatable heated dryer drum, which may be a Yankee dryer. The press roll may, in one embodiment, comprise a suction pressure roll. In order to adhere the web to the surface of the dryer drum, a creping adhesive may be applied to the surface of the dryer drum by a spraying device. The spraying device may emit a creping composition made in accordance with the present disclosure or may emit a conventional creping adhesive. The web is adhered to the surface of the dryer drum and then creped from the drum using the creping blade. If desired, the dryer drum may be associated with a hood. The hood may be used to force air against or through the web.

In other embodiments, once creped from the dryer drum, the web may be adhered to a second dryer drum. The second dryer drum may comprise, for instance, a heated drum surrounded by a hood. The drum may be heated from about 25° C. to about 200° C., such as from about 100° C. to about 150° C.

In order to adhere the web to the second dryer drum, a second spray device may emit an adhesive onto the surface of the dryer drum. In accordance with the present disclosure, for instance, the second spray device may emit a creping composition as described above. The creping composition not only assists in adhering the tissue web to the dryer drum, but also is transferred to the surface of the web as the web is creped from the dryer drum by the creping blade. Once creped from the second dryer drum, the web may, optionally, be fed around a cooling reel drum and cooled prior to being wound on a reel.

In addition to applying the creping composition during formation of the fibrous web, the creping composition may also be used in post-forming processes. For example, in one aspect, the creping composition may be used during a print-creping process. Specifically, once topically applied to a fibrous web, the creping composition has been found well-suited to adhering the fibrous web to a creping surface, such as in a print-creping operation.

For example, once a fibrous web is formed and dried the creping composition may be applied to at least one side of the web and the at least one side of the web may then be creped. In general, the creping composition may be applied to only one side of the web and only one side of the web may be creped, the creping composition may be applied to both sides of the web and only one side of the web is creped, or the creping composition may be applied to each side of the web and each side of the web may be creped.

In one embodiment the creping composition may be added to one side of the web by creping, using either an in-line or off-line process. A tissue web is passed through a first creping composition application station that includes a nip formed by a smooth rubber press roll and a patterned rotogravure roll. The rotogravure roll is in communication with a reservoir containing a first creping composition. The rotogravure roll applies the creping composition to one side of web in a preselected pattern. The web is then contacted with a heated roll, which can be heated to a temperature, for instance, up to about 200° C., and more preferably from about 100° C. to about 150° C. In general, the web can be heated to a temperature sufficient to dry the web and evaporate any water. It should be understood, that besides the heated roll, any suitable heating device can be used to dry the web. For example, in an alternative embodiment, the web can be placed in communication with an infra-red heater in order to dry the web. Besides using a heated roll or an infra-red heater, other heating devices can include, for instance, any suitable convective oven or microwave oven.

From the heated roll, the web can be advanced by pull rolls to a second creping composition application station, which includes a transfer roll in contact with a rotogravure roll, which is in communication with a reservoir containing a second creping composition. The second creping composition may be applied to the opposite side of the web in a preselected pattern. The first and second creping compositions may contain the same ingredients or may contain different ingredients. Alternatively, the creping compositions may contain the same ingredients in different amounts as desired. Once the second creping composition is applied the web is adhered to a creping roll by a press roll and carried on the surface of the creping drum for a distance and then removed therefrom by the action of a creping blade. The creping blade performs a controlled pattern creping operation on the second side of the tissue web. Although the creping composition is being applied to each side of the tissue web, only one side of the web undergoes a creping process. It should be understood, however, that in other embodiments both sides of the web may be creped.

Once creped the tissue web may be pulled through a drying station. The drying station can include any form of a heating unit, such as an oven energized by infra-red heat, microwave energy, hot air, or the like. drying station may be necessary in some applications to dry the web and/or cure the creping composition. Depending upon the creping composition selected, however, in other applications a drying station may not be needed.

The creping compositions of the present disclosure are typically transferred to the web at high levels, such that at least about 30 percent of the creping composition applied to the Yankee is transferred to the web, more preferably at least about 45 percent is transferred and still more preferably at least about 60 percent is transferred. Generally from about 45 to about 65 percent of the creping composition applied to the Yankee dryer is transferred to the web. Thus, the amount of creping additive transferred to the sheet is a function of the amount of creping additive applied to the Yankee dryer.

The total amount of creping composition applied to each side of the web can be in the range of from about 0.1 to about 10 percent by weight, based upon the total weight of the web, such as from about 0.3 to about 5 percent by weight, such as from about 0.5 to about 3 percent by weight. To achieve the desired additive application levels the add on rate of creping composition to the dryer, measured as mass (i.e., mg) per unit area of dryer surface (i.e., $m^2$), may range from about 50 to about 300 mg/m$^2$, and still more preferably from about 100 to about 200 mg/m$^2$.

Further, the creping composition is applied to the paper web so as to cover from about 15 to about 100 percent of the surface area of the web. More particularly, in most applications, the creping composition will cover from about 20 to about 60 percent of the surface area of each side of the web.

In one aspect, fibrous webs made according to the present disclosure can be incorporated into multiple-ply products. For instance, in one aspect, a fibrous web made according to the present disclosure can be attached to one or more other fibrous webs for forming a wiping product having desired characteristics. The other webs laminated to the fibrous web of the present disclosure can be, for instance, a wet-creped web, a calendered web, an embossed web, a through-air dried web, a creped through-air dried web, an uncreped through-air dried web, an airlaid web, and the like.

In one aspect, when incorporating a fibrous web made according to the present disclosure into a multiple-ply product, it may be desirable to only apply the creping composition to one side of the fibrous web and to thereafter crepe the treated side of the web. The creped side of the web is then used to form an exterior surface of a multiple-ply product. The untreated and uncreped side of the web, on the other hand, is attached by any suitable means to one or more plies.

In multiple-ply products, the basis weight of each fibrous web present in the product may vary. In general, the total basis weight of a multiple-ply product will be from about 33 to about 60 gsm, such as from about 33 to about 45 gsm, and more preferably from about 33 to about 40 gsm. In particularly preferred embodiments the tissue product is a multi-ply facial tissue wherein each ply has a basis weight from about 16 to about 30 gsm, such as from about 16.5 to about 22.5 gsm, and more preferably from about 17 to about 20 gsm.

Webs made according to the above processes, and products formed therefrom, have relatively low slough, such as less than about 8 mg, more preferably less than about 6 mg and still more preferably less than about 4 mg. For instance, for a web having a basis weight from about 16 to about 25 gsm, or a product having a basis weight from about 33 to 50 gsm, slough may vary from about 1 to about 8 mg, such as from about 2 to about 6 mg, or from about 2 to about 4 mg. Surprisingly, it has been discovered that treatment of tissue webs with the creping composition of the present disclosure results in tissue products having lower slough at a given basis weight relative to creped tissue products prepared according to the prior art. For example, tissue products of the present invention have sloughs from about 3 to about 5 mg at a basis weight of about 36 gsm.

Moreover, the relatively low sloughs are achieved at relatively modest geometric mean tensile strengths. This provides a tissue having the requisite softness and stiffness, without excessive pilling. For example, creped tissue products prepared according to the present disclosure have geometric mean tensile strengths of less than about 1000 g/3", and more preferably less than about 900 g/3", such as from about 700 to about 1000 g/3".

In addition to having low slough, webs and products prepared according to the present disclosure have improved softness, especially when prepared at higher basis weights, such as greater than about 16.5 gsm per ply. For example, tissue webs having a basis weight of at least about 16.5 gsm have a tissue softness value (also referred to herein as a "TS7 value"), measured using EMTEC Tissue Softness Analyzer ("TSA") (Emtec Electronic GmbH, Leipzig, Germany) as described in the Test Methods section, from about 8 to about 10. In a particularly preferred embodiment the present disclosure provides a tissue product comprising at least one creped web having a basis weight greater than about 16 gsm, a slough less than about 5 mg and a TSA value from about 8 to about 10.

Test Methods

Slough

Slough, also referred to as "pilling," is a tendency of a tissue sheet to shed fibers or clumps of fibers when rubbed or otherwise handled. The slough test provides a quantitative measure of the abrasion resistance of a tissue sample. More specifically, the test measures the resistance of a material to an abrasive action when the material is subjected to a horizontally reciprocating surface abrader. The equipment and method used is similar to that described in U.S. Pat. No. 6,808,595, the disclosure of which is herein incorporated by reference to the extent that it is non-contradictory herewith.

Figure 2:
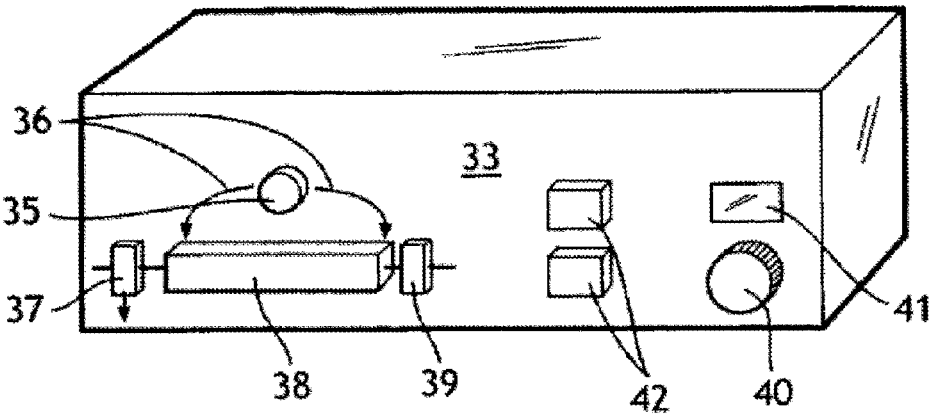
FIG. 2 illustrates a perspective view of a test apparatus that can be used to measure slough according to the test method set forth herein.
Figure 3:
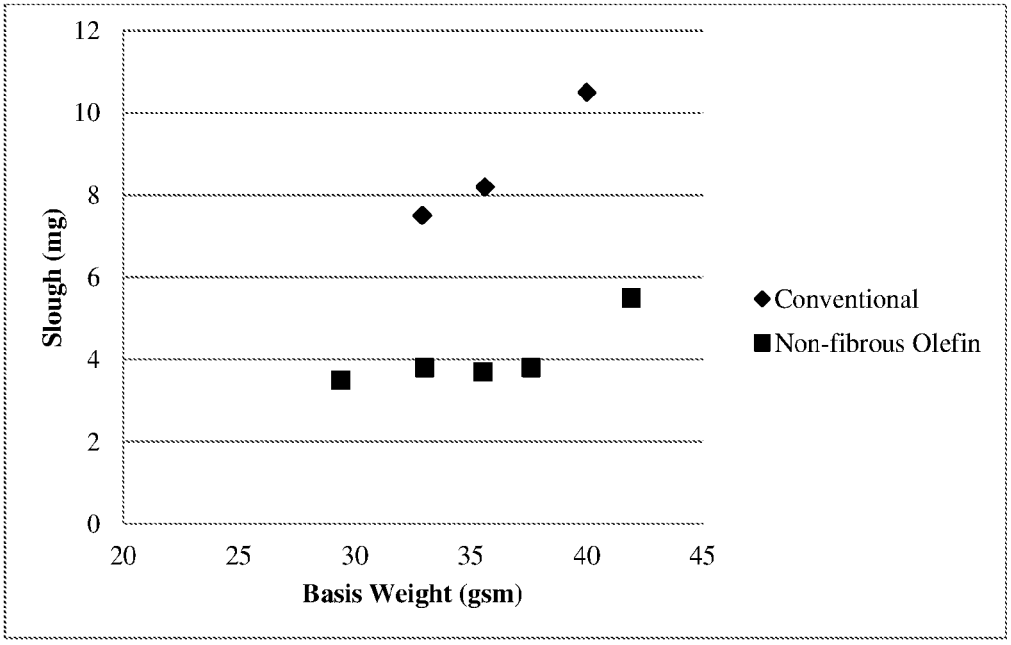
FIG. 3 is a comparison of basis weight (x-axis, grams per square meter) and slough (y-axis, mg) for two different creping chemistries.
Figure 4:
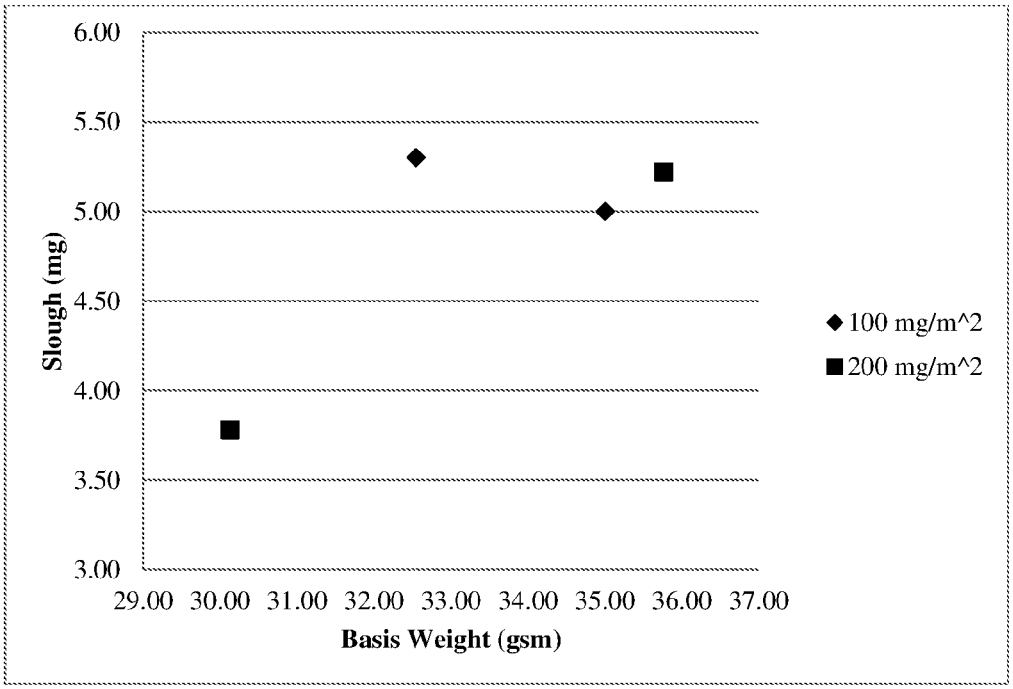
FIG. 4 is a comparison of basis weight (x-axis, grams per square meter) and slough (y-axis, mg) for different add-on levels of a non-fibrous olefin creping composition.

FIG. 2 is a schematic diagram of the test equipment used to measure pilling. Shown is the abrading spindle or mandrel 35, a double arrow 36 showing the motion of the mandrel 35, a sliding clamp 37, a slough tray 38, a stationary clamp 39, a cycle speed control 40, a counter 41, and start/stop controls 42. The abrading spindle 35 consists of a stainless steel rod, 0.5" in diameter with the abrasive portion consisting of a 0.005" deep diamond pattern knurl extending 4.25" in length around the entire circumference of the rod. The abrading spindle 35 is mounted perpendicularly to the face of the instrument 33 such that the abrasive portion of the abrading spindle 35 extends out its entire distance from the face of the instrument 33. On each side of the abrading spindle 35 is located a pair of clamps 37 and 39, one movable 37 and one fixed 39, spaced 4" apart and centered about the abrading spindle 35. The movable clamp 37 (weighing approximately 102.7 grams) is allowed to slide freely in the vertical direction, the weight of the movable clamp 37 providing the means for insuring a constant is tension of the tissue sheet sample over the surface of the abrading spindle 35.

Prior to testing, all tissue sheet samples are conditioned at 23±1° C. and 50±2% relative humidity for a minimum of 4 hours. Using a JDC-3 or equivalent precision cutter, available from Thwing-Albert Instrument Company, Philadelphia, Pa., the tissue sheet sample specimens are cut into 3±0.05" wide×7" long strips (note: length is not critical as long as specimen can span distance so as to be inserted into the clamps 37 and 39). For tissue sheet samples, the MD direction corresponds to the longer dimension. Each tissue sheet sample is weighed to the nearest 0.1 mg. One end of the tissue sheet sample is clamped to the fixed clamp 39, the sample then loosely draped over the abrading spindle or mandrel 35 and clamped into the sliding clamp 37. The entire width of the tissue sheet sample should be in contact with the abrading spindle 35. The sliding clamp 37 is then allowed to fall providing constant tension across the abrading spindle 35.

The abrading spindle 35 is then moved back and forth at an approximate 15 degree angle from the centered vertical centerline in a reciprocal horizontal motion against the tissue sheet sample for 20 cycles (each cycle is a back and forth stroke), at a speed of 170 cycles per minute, removing loose fibers from the surface of the tissue sheet sample. Additionally the spindle rotates counter clockwise (when looking at the front of the instrument) at an approximate speed of 5 RPMs. The tissue sheet sample is then removed from the jaws 37 and 39 and any loose fibers on the surface of the tissue sheet sample are removed by gently shaking the tissue sheet sample. The tissue sheet sample is then weighed to the nearest 0.1 mg and the weight loss calculated. Ten tissue sheet specimens per sample are tested and the average weight loss value in milligrams (mg) is recorded, which is the Pilling value for the side of the tissue sheet being tested.

Tissue Softness

Sample softness was analyzed using an EMTEC Tissue Softness Analyzer ("TSA") (Emtec Electronic GmbH, Leipzig, Germany). The TSA comprises a rotor with vertical blades which rotate on the test piece applying a defined contact pressure. Contact between the vertical blades and the test piece creates vibrations, which are sensed by a vibration sensor. The sensor then transmits a signal to a PC for processing and display. The signal is displayed as a frequency spectrum. The frequency analysis in the range of approximately 200 Hz to 1000 Hz represents the surface smoothness or texture of the test piece. A high amplitude peak correlates to a rougher surface. A further peak in the frequency range between 6 kHZ and 7 kHZ represents the softness of the test piece. The peak in the frequency range between 6 kHZ and 7 kHZ is herein referred to as the TS7 Softness Value and is expressed as dB V2 rms. The lower the amplitude of the peak occurring between 6 kHZ and 7 kHZ, the softer the test piece.

Test samples were prepared by cutting a circular sample having a diameter of 112.8 mm. All samples were allowed to equilibrate at TAPPI standard temperature and humidity conditions for at least 24-hours prior to completing the TSA testing. Only one ply of tissue is tested. Multi-ply samples are separated into individual plies for testing. The sample is placed in the TSA with the softer (dryer or Yankee) side of the sample facing upward. The sample is secured and the TS7 Softness Values measurements are started via the PC. The PC records, processes and stores all of the data according to standard TSA protocol. The reported TS7 Softness Value is the average of 5 replicates, each one with a new sample.

Tensile

Samples for tensile strength testing are prepared by cutting a 3 inches (76.2 mm)×5 inches (127 mm) long strip in either the machine direction (MD) or cross-machine direction (CD) orientation using a JDC Precision Sample Cutter (Thwing-Albert Instrument Company, Philadelphia, Pa., Model No. JDC 3-10, Ser. No. 37333). The instrument used for measuring tensile strengths is an MTS Systems Sintech 11S, Serial No. 6233. The data acquisition software is MTS TestWorks™ for Windows Ver. 4 (MTS Systems Corp., Research Triangle Park, N.C.). The load cell is selected from either a 50 Newton or 100 Newton maximum, depending on the strength of the sample being tested, such that the majority of peak load values fall between 10 and 90 percent of the load cell's full scale value. The gauge length between jaws is 2±0.04 inches (50.8±1 mm). The jaws are operated using pneumatic-action and are rubber coated. The minimum grip face width is 3 inches (76.2 mm), and the approximate height of a jaw is 0.5 inches (12.7 mm). The crosshead speed is 10±0.4 inches/min (254±1 mm/min), and the break sensitivity is set at 65 percent. The sample is placed in the jaws of the instrument, centered both vertically and horizontally. The test is then started and ends when the specimen breaks. The peak load is recorded as either the "MD tensile strength" or the "CD tensile strength" of the specimen depending on the sample being tested. At least six (6) representative specimens are tested for each product, taken "as is," and the arithmetic average of all individual specimen tests is either the MD or CD tensile strength for the product.

For multiple-ply products tensile testing is done on the number of plies expected in the finished product. For example, 2-ply products are tested two plies at one time and the recorded MD and CD tensile strengths are the strengths of both plies.

EXAMPLES

Inventive sample codes were made using a wet pressed process utilizing a Crescent Former. Initially, northern softwood kraft (NSWK) pulp was dispersed in a pulper for 30 minutes at 4 percent consistency at about 100° F. The NSWK pulp was then transferred to a dump chest and subsequently diluted to approximately 3 percent consistency. The NSWK pulp was refined at about 1 HP-days/MT. Softwood fibers were then pumped to a machine chest where they were mixed with 2 kg/MT of Kymene® 920A (Ashland Water Technologies, Wilmington, Del.) and 1 kg/MT Baystrength 3000 (Kemira, Atlanta, Ga.) of prior to the headbox. The softwood fibers were added to the middle side layer in the 3-layer tissue structure. The virgin NSWK fiber content contributed approximately 32 percent of the final sheet weight.

Eucalyptus hardwood kraft (EHWK) pulp was dispersed in a pulper for 30 minutes at about 4 percent consistency at about 100° F. The EHWK pulp was then transferred to a dump chest and diluted to about 3 percent consistency. The EHWK pulp fibers were then pumped to a machine chest where they were mixed with 2 kg/MT of Kymene® 920A. These fibers were added to dryer and felt layers, as indicated in the Table below.

TABLE 2

| Layer | Fiber Type | Additives | Weight % (total web) |
|---|---|---|---|
| Dryer | EHWK | 2 kg/MT Kymene ® 920A | 44 |
| Middle | NSWK | 2 kg/MT Kymene ® 920A<br>1 kg/MT Baystrength ™ 3000 | 32 |
| Felt | EHWK | 2 kg/MT Kymene ® 920A | 24 |

The pulp fibers from the machine chests were pumped to the headbox at a consistency of about 0.1 percent. Pulp fibers from each machine chest were sent through separate manifolds in the headbox to create a 3-layered tissue structure. The fibers were deposited onto a felt using a Crescent Former.

The wet sheet, about 10 to 20 percent consistency, was adhered to a Yankee dryer, traveling at about 2000 fpm (610 mpm) through a nip via a pressure roll. The consistency of the wet sheet after the pressure roll nip (post-pressure roll consistency or PPRC) was approximately 40 percent. The wet sheet is adhered to the Yankee dryer due to the creping composition that is applied to the dryer surface. A spray boom situated underneath the Yankee dryer sprayed the creping composition onto the dryer surface.

Two different creping compositions were evaluated. A conventional creping composition comprising, by weight on a solids basis, 70 percent Crepetrol™ Xcel and 30 percent Crepetrol™ 874 (both commercially available from Ashland Water Technologies, Wilmington, Del.) was prepared at about 1 percent solids. The flow rates of the conventional creping chemistry were varied to deliver a total addition of about 10 mg/m$^2$ spray coverage on the Yankee Dryer at the desired component ratio. A non-fibrous olefin dispersion, sold under the trade name HYPOD 8510 (Dow Chemical Co., Midland, Mich.) was also evaluated. The HYPOD 8510 was prepared at 30 percent solids and delivered at a total addition of about 200 mg/m$^2$ spray coverage on the Yankee Dryer.

TABLE 3

| Creping Composition | Creping Components (wt %) | Total Addition (mg/m$^2$) |
|---|---|---|
| Conventional | Crepetrol ™ Xcel (70%)<br>Crepetrol ™ 874 (30%) | 10 |
| Non-fibrous Olefin | HYPOD 8510 | 200 |

The sheet was dried to about 98 to 99 percent consistency as it traveled on the Yankee dryer and to the creping blade. The creping blade subsequently scraped the tissue sheet and a portion of the creping composition off the Yankee dryer. The creped tissue basesheet was then wound onto a core traveling at about 1575 fpm (480 mpm) into soft rolls for converting. Two soft rolls of the creped tissue were then rewound, calendered, and plied together so that both creped sides were on the outside of the 2-ply structure. Mechanical crimping on the edges of the structure held the plies together. The plied sheet was then slit on the edges to a standard width of approximately 8.5 inches, and cut to facial tissue length. Tissue samples were conditioned and tested. Table 4 summarizes the conditions under which the samples of the present example were prepared. Table 5 summarizes the physical properties of the samples prepared as described herein.

TABLE 4

| Sample | Creping Composition | Add On (mg/m$^2$) | Web Target Basis Weight (gsm) | Finished Product Plies (No.) |
|---|---|---|---|---|
| 1 | Conventional | 10 | 16.2 | 2 |
| 2 | Conventional | 10 | 17.75 | 2 |
| 3 | Conventional | 10 | 20.4 | 2 |
| 4 | Non-fibrous Olefin | 200 | 14.2 | 2 |
| 5 | Non-fibrous Olefin | 200 | 16.8 | 2 |
| 6 | Non-fibrous Olefin | 200 | 17.75 | 2 |
| 7 | Non-fibrous Olefin | 200 | 18.5 | 2 |
| 8 | Non-fibrous Olefin | 200 | 21.3 | 2 |

TABLE 5

| Sample | Basis Weight (gsm) | Slough (mg) | GMT (g/3") | Single Ply Caliper (μm) | Single Ply Basis Weight (gsm) |
|---|---|---|---|---|---|
| 1 | 32.9 | 7.5 | 702 | 238.8 | 16.4 |
| 2 | 35.6 | 8.2 | 708 | 249.6 | 17.8 |
| 3 | 40.0 | 10.5 | 841 | 259.1 | 20.0 |

TABLE 5-continued

| Sample | Basis Weight (gsm) | Slough (mg) | GMT (g/3") | Single Ply Caliper (μm) | Single Ply Basis Weight (gsm) |
|---|---|---|---|---|---|
| 4 | 29.4 | 3.5 | 711 | 212.2 | 14.7 |
| 5 | 33.0 | 3.8 | 802 | 226.3 | 16.5 |
| 6 | 35.5 | 3.7 | 876 | 237.6 | 17.8 |
| 7 | 37.6 | 3.8 | 1082 | 236.0 | 18.8 |
| 8 | 41.9 | 5.5 | 1184 | 256.0 | 21.0 |

Referring to FIG. 2, the effect of basis weight on slough is illustrated for the two creping compositions of the present example. As can be seen from FIG. 2, for tissue webs treated with conventional creping compositions, slough increases significantly as basis weight increases. However, for inventive an increase in basis weight is accompanied by only a negligible increase in slough. Indeed, even when basis weight is increased by as much as 28 percent, slough increases by only about 0.3 mg.

In this manner, it is believed that the additive composition provides strength to the outer most layer of the web without significantly increasing the geometric mean tensile of the web. Of particular advantage, these results are obtained without a substantial increase in stiffness of the tissue web and without a substantial decrease in the perceived softness.

To further explore the relationship between the non-fibrous olefin creping composition, basis weight and slough, additional tissue products were prepared as described above, but the creping composition was added at two different add-on levels—200 mg/m$^2$ and 100 mg/m$^2$. The physical properties are summarized in the table below.

TABLE 6

| Add On (mg/m$^2$) | Basis Weight (gsm) | GMT (g/3") | Single Ply Basis Weight (gsm) | MD Slope | CD Slope | Slough (mg) |
|---|---|---|---|---|---|---|
| 100 | 32.54 | 792.40 | 16.27 | 11.03 | 12.92 | 5.30 |
| 100 | 35.00 | 834.42 | 17.50 | 10.77 | 11.87 | 5.00 |
| 200 | 30.13 | 771.13 | 15.06 | 10.33 | 13.87 | 3.78 |
| 200 | 35.76 | 821.32 | 17.88 | 11.68 | 12.68 | 5.22 |

Finally, to explore the relationship between basis weight, softness and slough, additional inventive samples were prepared as described above. The non-fibrous olefin creping composition was applied at an add-on level of 100 mg/m$^2$ to prepare both the control and inventive samples. Tissue softness was measured using the TSA instrument as described above. The physical properties of the control and inventive samples, as well as comparative commercial tissue samples, are summarized in the table below.

TABLE 7

| Sample | Creping Composition | Add-On (mg/m$^2$) | Basis Weight (gsm) | GMT (g/3") | GMM (kg) | Slough (mg) | TS7 |
|---|---|---|---|---|---|---|---|
| Control | Non-fibrous Olefin | 100 | 28.6 | 825 | 11.64 | 1.4 | 10.8 |
| Inventive | Non-fibrous Olefin | 100 | 33.3 | 805 | 6.99 | 1.9 | 9.7 |
| Inventive | Non-fibrous Olefin | 100 | 36.6 | 790 | 9.31 | 3.9 | 9.2 |
| Publix ® Facial Tissue | — | — | 32.62 | 741 | 10.75 | 1.13 | 12.7 |
| Puffs Basic ® Facial Tissue | — | — | 29.82 | 665 | 7.18 | 6.13 | 10.2 |
| Scotties ® 2-Ply Facial Tissue | — | — | 31.34 | 816 | 14.82 | 2.85 | 12.6 |
| Up&Up ™ Everyday Facial Tissue | — | — | 30.75 | 814 | 10.59 | 3.79 | 11.1 |

These and other modifications and variations to the present invention may be practiced by those of ordinary skill in the art. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

We claim:

1. A creped tissue product comprising two creped tissue webs, wherein the basis weight of each creped tissue web is greater than about 16.5 grams per square meter (gsm), the product having a basis weight from about 33 to about 50 gsm, a slough less than about 6 mg, a geometric mean tensile (GMT) from about 600 to about 1,000 g/3" and a ratio of product GMT to per ply basis weight less than about 50.

2. The creped tissue product of claim 1, wherein the basis weight of each web is from about 16.5 to about 20.0 gsm.

3. The creped tissue product of claim 1, wherein the GMT of the product is from about 700 to about 900 g/3" and the product has a basis weight from about 33 to about 40 gsm.

4. The creped tissue product of claim 1, wherein the product has a slough from about 2 to about 5 mg.

5. The creped tissue product of claim 1 having a TS7 value less than about 10 dB V2 rms.

6. The creped tissue product of claim 1, wherein the product has a basis weight from about 33 to about 40 gsm and a GMT from about 700 to about 900 g/3" and a slough from about 2 to 4 mg.

7. The creped tissue product of claim 1, wherein the ratio of product GMT to per ply basis weight is less than about 45.

8. The creped tissue product of claim 1 having a TS7 value from about 8 to about 10 dB V2 rms.

9. A multi-ply tissue product comprising two multi-layered creped tissue webs, the tissue webs having three superposed layers, an inner layer consisting essentially of softwood fibers and two outer layers consisting essentially of hardwood fibers, the inner layer being located between the two outer layers, wherein each multi-layered creped tissue web has a basis weight of at least about 16.5 grams per square meter (gsm), the product having a basis weight from about 33 to about 50 gsm, a slough less than about 4 mg, a geometric mean tensile (GMT) from about 600 to about 1,000 g/3" and a ratio of GMT to per ply basis weight less than about 50.

10. The multi-ply tissue product of claim 9, wherein the product has a basis weight from about 33 to about 42 gsm.

11. The multi-ply tissue product of claim 9, wherein the ratio of GMT to per ply basis weight is less than about 45.

12. The creped tissue web of claim 9, wherein the hardwood fibers comprising at least about 60 percent and the softwood fibers comprising less than about 40 percent of the total weight of the web.

13. The multi-ply tissue product of claim 9, wherein at least one of the tissue webs comprises a non-fibrous olefin polymer disposed thereon.

14. The multi-ply tissue product of claim 3, wherein the olefin polymer comprises an alpha-olefin interpolymer of ethylene and at least one comonomer selected from the group consisting of a $C_{4-20}$ linear, branched or cyclic diene, vinyl acetate, and a compound represented by the formula $H_2C{=}CHR$, wherein R is a $C_{1-20}$ linear, branched or cyclic alkyl group or a $C_{6-20}$ aryl group, or the alpha-olefin polymer comprises a copolymer of propylene with at least one comonomer selected from the group consisting of ethylene, a $C_{4-20}$ linear, branched or cyclic diene, and a compound represented by the formula $H_2C{=}CHR$, wherein R is a $C_{1-20}$ linear, branched or cyclic alkyl group or a $C_{6-20}$ aryl group.

15. The multi-ply tissue product of claim 3, wherein the creping composition is present on or in the tissue web in an amount from about 0.1 to about 5 percent by weight of the web.

16. The multi-ply tissue product claim 9 having a TS7 value from about 8 to about 10 dB V2 rms.

* * * * *